US005169446A

United States Patent [19]

Koksbang et al.

[11] Patent Number: 5,169,446

[45] Date of Patent: Dec. 8, 1992

[54] METHOD AND APPARATUS FOR COATING ALKALI OR ALKALINE EARTH METALS

[75] Inventors: Rene Koksbang, Odense; Gert L. Jensen, Svendborg, both of Denmark

[73] Assignee: MHB Joint Venture

[21] Appl. No.: 717,314

[22] Filed: Jun. 18, 1991

Related U.S. Application Data

[60] Division of Ser. No. 642,170, Jan. 17, 1991, Pat. No. 5,080,932, which is a continuation of Ser. No. 389,193, Aug. 2, 1989, abandoned.

[51] Int. Cl.[5] ..... B05C 1/02; B05C 1/08

[52] U.S. Cl. ..... 118/69; 118/244; 118/249; 118/259; 228/43

[58] Field of Search ..... 118/244, 249, 259, 69, 118/410, 419, 304; 228/37, 43

[56] References Cited

U.S. PATENT DOCUMENTS

| | | | |
|---|---|---|---|
| 3,086,879 | 4/1963 | Lassiter et al. | 427/241 |
| 3,928,681 | 12/1975 | Alaburda | 427/431 |
| 4,246,865 | 1/1981 | Shimada et al. | 118/65 |
| 4,254,158 | 3/1981 | Fukuzuka et al. | 427/8 |
| 4,307,128 | 12/1981 | Nagano et al. | 427/57 |
| 4,321,289 | 3/1982 | Bartsch | 118/69 X |

FOREIGN PATENT DOCUMENTS

| | | | |
|---|---|---|---|
| 0285476 | 10/1988 | European Pat. Off. . | |
| 54-132433 | 10/1979 | Japan . | |
| 55-6470 | 1/1980 | Japan . | |
| 55-63152 | 5/1980 | Japan . | |
| 55-97458 | 7/1980 | Japan . | |
| 577706 | 10/1977 | U.S.S.R. | 228/37 |
| 959943 | 9/1982 | U.S.S.R. | 228/37 |

*Primary Examiner*—Michael G. Wityshyn
*Attorney, Agent, or Firm*—Cooley, Godward, Castro, Huddleson & Tatum

[57] ABSTRACT

A process for forming a layer of metal on a substrate which comprises the steps of: (a) forming a bath of a molten metal in a vessel; (b) circulating said molten metal in said bath such that said molten metal is projected above the upper surface of said vessel (c) transporting a substrate along a path which traverses the upper surface of said vessel; and (d) transferring said molten metal to one surface of said substrate by directly or indirectly contracting said molten metal with said surface of said substrate, and an apparatus for performing the method is disclosed.

4 Claims, 3 Drawing Sheets

METHOD AND APPARATUS FOR COATING ALKALI OR ALKALINE EARTH METALS

This application is a divisional application of U.S. application Ser. No. 07/642,170 filed Jan. 17, 1991, now U.S. Pat. No. 5,080,93, which is a continuation of Ser. No. 389,193, filed Aug. 2, 1989, now abandoned.

BACKGROUND OF THE INVENTION

1. Field of the Invention

The present invention relates to a process and apparatus for coating alkali and alkaline earth metals and more particularly lithium onto a substrate.

2. Description of the Prior Art

Presently, there is a high level of interest in industry in designing thin layer lithium batteries. These batteries include a lithium anode, a transition metal oxide-polymer composite as a cathode, and an electrolyte which may be a solid or a liquid and which includes a dissolved lithium salt.

A principal objective of the designers of these batteries, particularly in applications in which large electrode areas are needed, is to make them as thin as possible while satisfying market needs in terms of capacity, current density, shelf-life and the like.

While methods for making lithium anodes are known, these methods typically provide an anode containing much more lithium than is necessary to meet the electrochemical requirements of the cell. As a consequence, lithium is wasted, the battery is more expensive, and the battery is substantially thicker than necessary. For example, the most common method for fabricating lithium anodes is cold extrusion, but it is difficult to extrude lithium metal into strips thinner than about 100 microns. U.S. Pat. No. 3,721,113, describes a method for alleviating this difficulty by rolling the lithium between smooth polymeric surfaces having sufficiently low critical surface energy to prevent adhesion, however, even this method is limited to thicknesses not less than about 40 microns. In addition, pre-produced lithium strips having a thickness of less than 50 microns are extremely expensive. As such, they do not present a commercially attractive alternative.

Other methods for coating lithium are known in the art as illustrated by U.S. Pat. No. 3,551,184 to Dremann et al. which involves rubbing a heated substrate with a rod of lithium metal and U.S. Pat. No. 3,928,681 and European Published Application No. 285,476 wherein metal substrates are coated as they are conveyed through an alkali metal melt or across a roller which has been immersed in the alkali metal metal. Each of these methods has drawbacks which would make them difficult to implement in an industrial setting. For example, if the apparatus according to European Published Application No. 285,476 would unexpectedly shut down, the roller could quickly corrode and the apparatus would be rendered inoperable.

SUMMARY OF THE INVENTION

The present invention provides a method and apparatus for providing a coating of lithium or another alkali or alkaline earth metal having a controlled thickness, preferably less than 150 microns, on a substrate. More particularly, the present invention provides a method and apparatus for forming lithium or other alkali or alkaline earth metal anodes for use in electrochemical cells wherein a current collector, such as nickel or copper foil, is coated with a thin layer of the alkali or alkaline earth metal.

While the discussion hereafter will refer to lithium it will be apparent that other alkali or alkaline earth metals can be coated in an analogous manner. Similarly, while the discussion hereafter will make reference to coating metal foil members for use as anodes in lithium cells, the method can be used to provide a microscopic thickness metal coating on substantially any type of substrate on which a microscopic thickness metal coating would be desired.

In accordance with the present invention, a substrate is coated with a thin layer of lithium metal by transporting the substrate across an area whereupon it contacts molten lithium metal. More particularly, the molten lithium metal is preferably maintained in a vessel and circulated such that a stream of the molten lithium is projected beyond the upper surface of the vessel. The substrate passes directly above the vessel, without touching the vessel itself, and is located in a position to enable the projected molten lithium to contact the substrate. The contact of the molten lithium metal with the substrate is controlled to enable a very thin and pure coating of lithium to be provided to the substrate. Once the substrate, after coating, has cooled to below the melting point of lithium (180° C.), the lithium coating solidifies onto the substrate. By manipulation of a number of variables such as the contact time between the substrate and the molten lithium, the temperature of the substrate, the temperature of the molten lithium, projectile action of the molten lithium, and the like, desired coating thicknesses of uncontaminated lithium can be produced. More specifically, the process enables very thin coating thicknesses in the micron and sub-micron size range to be produced.

In accordance with one embodiment of the present invention, a process for forming a layer of a metal on a substrate is provided. The method includes the steps of:

(a) forming a bath of a molten metal in a vessel;
(b) circulating said molten metal in said bath such that said molten metal is projected above the upper surface of said vessel;
(c) transporting a substrate along a path which traverses above the upper surface of said vessel; and
(d) transferring said molten metal to one surface of said substrate by directly or indirectly contacting said projected molten metal with said surface of said substrate.

It is particularly preferred that the molten metal be projected in the form of a standing wave, and that the substrate contact the projected molten metal. This type of projection enables the formation of a thin and pure coating of metal onto the substrate. Contact may be accomplished by either directly passing the substrate across the standing wave, or by an indirectly method wherein the molten metal of the standing wave is transferred to a rotating transfer roll which, in turn, transfers the molten metal to a substrate which is in directly contact with the rotating roll. In addition, it is particularly preferred that the substrate be cooled shortly after coating to rapidly solidify the metal coating onto the substrate. A particularly preferred method of achieving this is by applying a chilled member, typically a roller, to the uncoated surface of the substrate.

In other embodiments, the method of the present invention may be utilized to coat both sides of a substrate. To accomplish this two rotating rolls are provided, each roll being in contact with the other and the substrate, and each roll having a width greater than the width of the substrate. The first rotating roll contacts the molten metal and transfers it to the surface of the substrate which it contacts. Further, since the width of the roll is wider than the width of the substrate, the molten metal present at the edges of the roll is transferred to the second roll which is in contact with the uncoated side of the substrate. After transfer to the second roll, the molten metal migrates towards the center of the second roll and contacts the previously uncoated surface of the substrate to produce a coating layer on that surface. As a result, upon cooling a substrate having metal layer coatings on both surfaces is produced.

Because the above method is particularly suited for coating alkali metals, an especially lithium onto a substrate, the process takes places in an inert environment, preferably a very dry argon or helium environment.

In accordance with another embodiment of the present invention a substrate having a layer of metal coated thereon is provided. The substrate is produced from the above described method.

In particular it is envisioned that the substrate be used as an anode element for a laminar battery, and in particular, a laminar lithium battery wherein the substrate comprises a metal foil or a metal screen, and in particular, a copper or nickel foil or screen.

In still another embodiment, an apparatus for coating a metal onto a substrate is provided. The apparatus comprises:

a vessel for maintaining a molten metal;

circulating means in said vessel for circulating said molten metal and causing said molten metal to project above the upper surface of said vessel;

transport means for transporting a substrate across said vessel to enable said projected molten metal to directly or indirectly contact a surface of the substrate; and coating means for coating said projected molten metal onto the substrate.

In a particular embodiment, the apparatus includes a rotating transfer roll as the coating means which contacts the projected molten metal and transfers the metal to one surface of the substrate material, as well as a chilling roll for cooling the substrate after the molten metal has been coated on to it. The chilling roll is preferably in contact with the uncoated surface of the substrate, and can be located horizontally or vertically at any point along the surface of the substrate to provide appropriate degrees of tension and cooling to the substrate relative to the point of contact with the molten metal to thereby provide coatings having a desired thickness.

In an alternative embodiment, the chilling roll may be replaced by a second rotating roll which is in contact with both the first rotating roll and the uncoated surface of the substrate to enable molten metal to be coated onto both surfaces of the substrate.

Accordingly, it is an object of the present invention to provide a process for coating a thin layer of an uncontaminated alkali or alkaline earth metal, particularly lithium, onto a substrate.

A further object of the present invention is to provide a substrate having a thin coating of an uncontaminated alkali or alkaline earth metal on one or both of its surfaces.

A still further object of the present invention is to provide an apparatus for coating a thin layer of an uncontaminated alkali or alkaline earth metal onto a substrate.

These, as well as other objects will be readily understood by those skilled in the art as reference is made to the following drawings and detailed description of the preferred embodiment.

DETAILED DESCRIPTION OF THE PREFERRED EMBODIMENT

While describing the preferred embodiment, certain terminology will be utilized for the sake of clarity. Use of such terminology encompasses not only the described embodiment but all technically equivalents which operate and function in substantially the same way to bring about the same result.

Figure 1A:
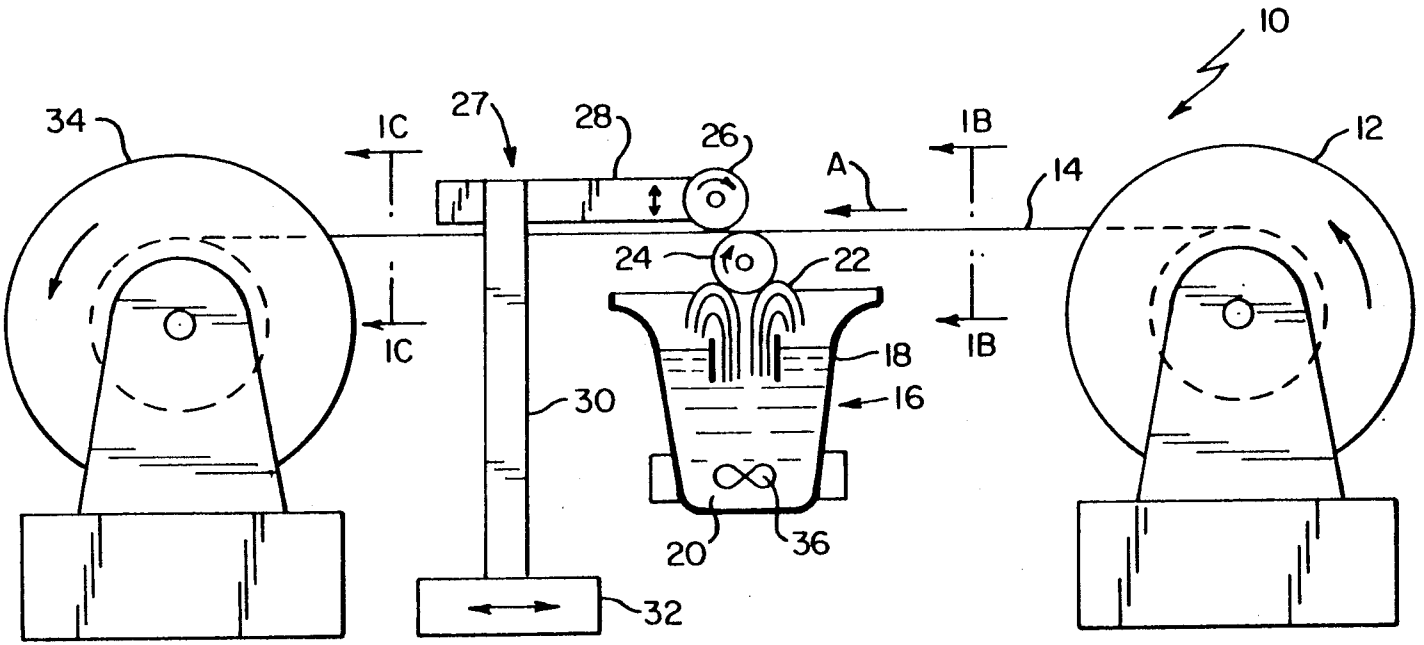
FIG. 1A is a schematic diagram of an apparatus embodying the teachings of the instant invention.

Referring now to the drawings, and more particularly FIG. 1, an apparatus and process for coating a thin layer of a metal on a substrate embodying the teachings of the instant invention is designated as 10. It is intended that apparatus 10 be used to coat a thin layer of lithium onto metal foil substrates, but those skilled in the art will readily appreciate that other coating metals besides lithium such as sodium, calcium magnesium, and aluminum may be coated onto substrates in accordance with the present invention.

Figure 1C:
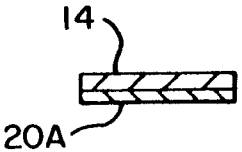
FIG. 1B illustrates a substrate as a uniform material having no surface coatings and FIG. 1C illustrates the substrate after coating on the lower surface.
Figure 1B:
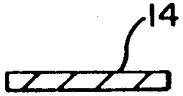

Apparatus 10 includes unwinding transport roller 12 which rotates in the direction of the arrow to pay out substrate 14. Substrate 14 moves in the direction of arrow A across metal coating station 16 and onto take-up roller 34, which is rotating to transport substrate 14 throughout the apparatus. Prior to transporting across metal coating station 16, substrate 14 is a uniform material typically having no surface coatings as is seen in FIG 1B. If the substrate would otherwise react with the metal to be coated on it, the substrate may be precoated with a non reactive layer. For example, if an aluminum substrate is selected, it can react with lithium to form a brittle alloy. To prevent this from occurring, the aluminum substrate may be pre-coated with an nickel layer, which does not react with lithium. Once substrate has passed through metal coating station 16, and subsequently cooled, a solid layer of metal 20A as shown in FIG. 1C is coated on the lower surface of the substrate 14.

Figure 2:
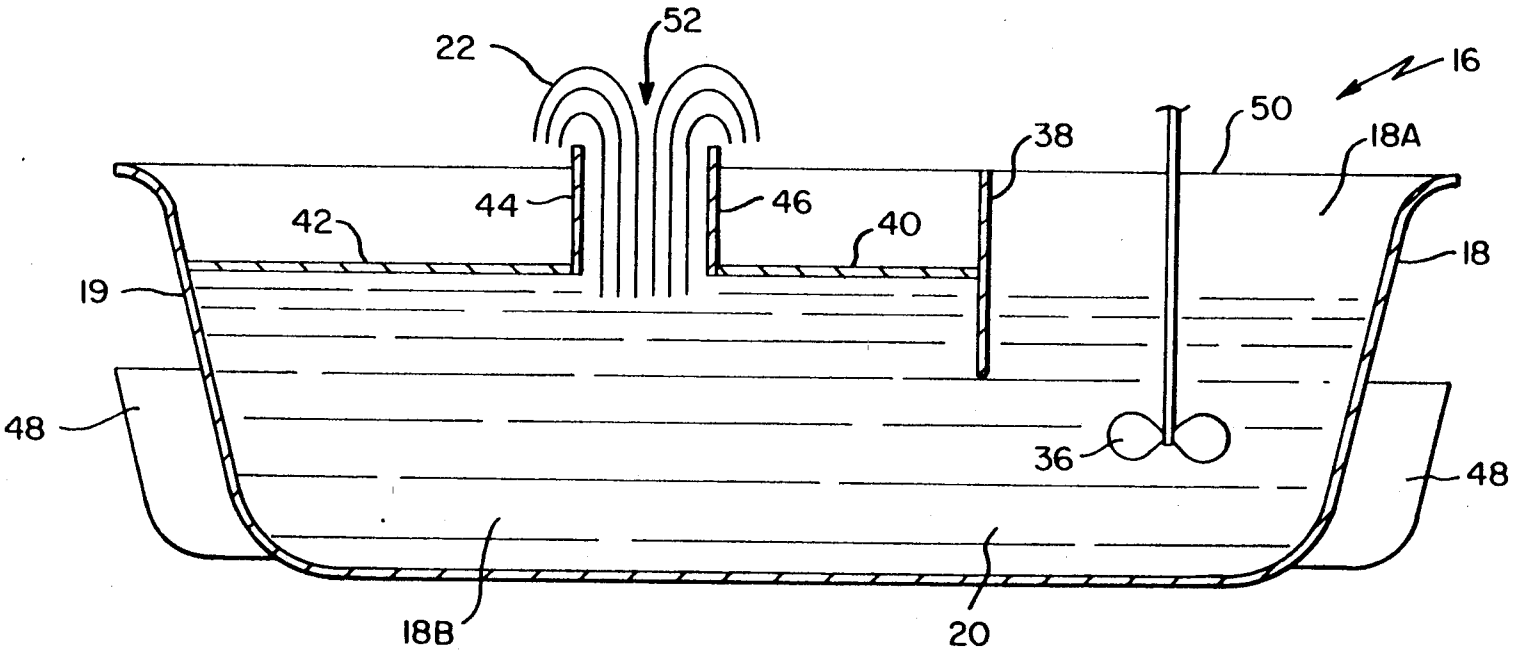
FIG. 2 is a expanded view of the vessel containing the molten lithium bath.

Referring now to FIG. 2, metal coating station 16 is shown in greater detail. Station 16 includes vessel 18 which houses molten metal 20. Mounted on the exterior surface of vessel 18 are heaters 48 which heat vessel 18 to melt or maintain metal 20 in a liquid stat. Vessel 18 also includes longitudinal gate 38 which separates vessel 18 into areas 18A and 18B. As will be discussed later, the presence of gate 38 enables the bath of molten metal 20 to be projected as a standing wave 22 such that the crest of standing wave 22 extends above the upper surface 50 of vessel 18. Also located in area 18A is stirrer 36 for circulating the metal in vessel 18.

Still referring to FIG. 2, area 18B includes flow restriction wall 40 which connects gate 38 to vertical baffle 46. Area 18B includes flow restriction wall 42 which connects side wall 19 of vessel 18 to vertical baffle 44. The vertical location of flow restriction walls 40 and 42 in vessel 18 is slightly below upper surface 50. Baffles 44 and 46 are connected at walls 40 and 42 and terminate vertically at surface 50 to create opening 52 through which standing wave 22 projects.

Referring back to FIG. 1, apparatus 10 also includes coating roll 24 which contacts standing wave 22 of molten metal 20. Coating roll 24 rotates in the direction of the arrow to enable the molten metal present on its external surface to contact the lower surface of substrate 14. Coating roll 24 primarily functions to apply a uniform, continuous coating of molten metal onto substrate 14. However, the presence of coating roll 24 is optional. If coating roll 24 is not present in apparatus 10, the height of substrate 14 with respect to standing wave 22 is adjusted so that the lower surface of substrate 14 directly contacts the crest of standing wave 22 to enable molten metal 20 from vessel 18 to be directly coated onto substrate 14.

Still referring to FIG. 1, apparatus 10 also includes chilling roll 26 which functions to cool the uncoated surface of substrate 14 to rapidly solidify the molten metal coating. The presence of chilling roll 26 is optional and the lower surface of chilling roll 26 contacts the upper surface of substrate 14. Chilling roll is mounted onto support 27 which includes horizontal arm 28, vertical arm 30 and base 32. Horizontal arm 28 is vertically adjustable and base 32 is horizontally adjustable. As will be discussed later, the adjustability of horizontal arm 28 and base 32 allows for control of the coating thickness of molten metal.

To coat a thin metal layer onto a substrate using the apparatus of FIG. 1, the following procedure is utilized. The uncoated substrate 14 is advanced to where it contacts coating roller 24 which in turn coats molten metal 20 onto the lower surface of substrate 14.

To enable a sufficient amount of molten metal to be transferred from coating roll 24 to substrate 14 coating roll 24 must be rotating at a sufficiently rapid rate, for example 50 to 500 rpm. Rotation which is too slow results in an insufficient amount of molten metal to be transferred to the substrate.

The coating of molten metal 20 onto coating roller 24 is effectuated at coating station 16. More particularly, a solid metal is deposited into vessel 18 and heaters 48 are activated to melt metal 20 into a molten state. Stirrer 36 is then activated to cause the formation of standing wave 22 by creating a flow of molten metal 20 underneath gate 38 and into area 18B. To equilibriate the pressure in area 18B, molten metal 20 is circulated through opening 52 as standing wave 22. The formation of molten metal 20 as standing wave 22 is naturally accomplished by the activation of stirrer 36 and the requirement that pressure equilibrium be maintained in vessel 18, particularly in region 18B. Stirrer 36 operates at about 100 to 300 rpm.

As seen in FIG. 1, molten metal 20 from standing wave contacts the external surface of coating roll 24. The molten metal that does not contact coating roll 24 projects above gate 38 into area 18A of vessel 18 and is then recirculated in vessel 18 for subsequent coating onto coating roll 24.

After molten metal 20 has been coated onto substrate 14, substrate 14 is advanced to contact chilling roll 26 on its uncoated surface. Chilling roll 26, which is typically a water cooled roller (i.e. water is circulated in the interior of the roll), functions primarily to rapidly solidify the molten metal on substrate 14. Other cooling fluids, such as freon and other refrigerants may be substituted for water. It also functions to control the coating thickness of molten metal 20 on substrate 14. Because chilling roll 26 is in direct contact with the uncoated surface of substrate 14, a tension is created on substrate 14 to force it into contact with coating roll 24. Depending upon the amount of tension on substrate 24, the thickness of the metal coating can effectively be controlled. Increased tension is created where the chilling roll is horizontally and vertically closes to coating roll 24. The horizontal and vertical location of chilling roll 26 on substrate 14 is controlled by base 32 and horizontal arm 28 respectively. For example, to enable a very thin coating to be formed on substrate 14, base 32 is adjusted towards coating roll 24 and horizontal arm 28 is vertically lowered towards coating roll 24. Conversely, to produce a thicker coating onto substrate 14, base 32 can be adjusted away from coating roll 24 and horizontal arm 28 can be vertically raised away from coating roll 24.

Once coated and cooled, coated substrate 14 is advanced by, and wound onto take up roll 34.

The apparatus shown in FIG. 1 is particularly designed for coating thin layers of alkali metals, particularly lithium, onto a metal substrate. Accordingly, apparatus 10 must be maintained in a chemically inert (essentially free of water, nitrogen and oxygen) environment to prevent reaction with lithium. Example of suitable environments include argon, helium and neon, with an argon environment being particularly preferred, being maintained at ambient pressure and temperature.

Lithium, and other reactive metals (alkali to alkaline earth metals), are all very sensitive to oxygen, nitrogen and water, especially when the metals are in the molten state. Even in high purity glove boxes, in which the water and oxygen level is lower than one ppm, the surface of the molten lithium is contaminated. The contamination is observed as a gray surface layer (presumably consisting of lithium oxide, nitride and hydroxide) which grows in time. On a static lithium surface, this contamination layer has to be removed frequently. Coating of a substrate from this contaminated lithium, produces a coating containing lumps/plates of the contaminant. The thickness of the contaminants usually exceeds the thickness of the lithium layer by a factor of 2-5. This lithium coating is obviously not commercially usable, for example, as an anode material for thin film lithium batteries.

By comparison, the standing wave apparatus of the present invention takes advantage of a flow of molten lithium. This means that the contamination on the surface of the melt is instantly removed as impurities are transported away from the coating zone. The impurities are accumulated on the surface of the molten lithium in other parts of the apparatus from where they can be removed easily without disturbing the coating process.

As the standing wave is formed by lithium from the bottom of the apparatus, contamination of the lithium coating is avoided. Thus, the lithium surface is always free from impurities.

Examples of metal substrates which may be coated in accordance with the present invention include nickel, copper, aluminum, tin and lead. Other substrate materials may be selected as long as they are solid at the coating temperature and do not react with the coating metal. For example, as discussed above, reactive metals (i.e. metals that react with lithium at room temperature) should be precoated with a nonreactive layer. The substrate may either be solid, for example a foil, or porous such as a screen. The latter substrate may be utilized for producing a two sided coating as the molten metal, once coated onto the lower surface of the substrate will interpenetrate the pores of the substrate and transfer the molten metal to the opposite surface of the substrate. Examples of particularly useful porous substrate include nickel meshes and screens.

Coating station 16 must be designed to enable the metal to be melted and projected as a standing wave. In practice, to produce a molten lithium bath, heaters 48 must be capable of heating vessel 18 to a temperature greater than the melting point of lithium (180° C.). Maintaining a lithium bath between the melting point of pure lithium and about 400° C. produces excellent results. A bath temperature of about 250° C. is particularly preferred. To produce the standing wave effect, a machine capable of producing a standing wave being equipped with a stirrer may be selected. Once such machine is a Lotanlage Compac 1018, sold by Seitz and Hohnerlein of Kreuzwertheim, West Germany. This machine, when modified as shown in FIG. 2, is capable of producing a standing wave whose crest is projected approximately 1 centimeter above the upper surface of the vessel.

When a coating roll is utilized to transfer molten lithium from the standing wave to the substrate, the coating roll should have a continuous external surface to enable a uniform coating of lithium to be coated onto the substrate. An example of one suitable coating roll is a 2.5 centimeter diameter stainless steel roller having a polished surface. This roll is typically maintained at a temperature about the temperature of the molten metal.

When a chilling roll is utilized, it is preferably a water coated or other fluid (those which do not react with lithium) coated interior (room temperature (20° C.)), stainless steel or copper exterior roller. Such rollers are well known in the art.

Base 32 and horizontal arm 28, as discussed above, can be adjusted to provide a desired location on substrate 14. For example, base 32 can be adjusted to enable chilling roll 26 to nearly contact coating roll 24, or can be adjusted so that chilling roll is displaced an appropriate distance (typically about 5 centimeters) from coating roll 24. Similarly, horizontal arm 28 can be adjusted to a height of about 3 cm above coating roll 24. In practice, to produce thin coatings, horizontal arm 28 may be adjusted with 0.1–2 millimeters from coating roll 24. By adjusting base 32 and horizontal arm 28, the degree of contact between the substrate 14 and the molten lithium can be adjusted and coating thicknesses ranging between less than 1 and about 500 microns may be produced. Particularly preferred coating thicknesses range from about 15 microns to be about 100 microns.

Another, but less important factor which may be utilized to control coating thicknesses is the rotational speed of take up roll 34, which in turn controls the transport rate of substrate 14. In practice, roll 34 is rotated at a rate to enable substrate 14 to move across coating station 16 at a rate of about 1 to about 15 meters per minute. A transport rate of about 10 meters per minute is particularly preferred.

An additional factor which may be used to control coating thickness is the rotational speed of coating roller 24. In general, increased coating thickness results from an increase in the rotational speed of coating roll 24. In practice, coating roll 24 rotates at a speed ranging from about 50 rpm to about 500 rpm.

Still another factor which can be used to control coating thickness is the temperature of the substrate prior to coating. If the temperature of the substrate is increased, it is believed that the coating thickness will decrease. In practice, the substrate is typically maintained at room temperature. However, to improve adhesion of the coating to the substrate, the substrate may be heated prior to the coating. After coating, the temperature of the chilling roll may also affect coating thickness. Lowering the temperature of the chilling roll can lead to faster solidification of the coated metal while increasing the temperature of the chilling roll can improve the uniformity of the coating.

To further control coating quality, the height of the standing wave is adjusted to provide an impurity free metal coating while giving the appearance of being static. If the appearance of the wave is static, a uniform coating can be applied to the substrate. By comparison, if the wave provides a oscillating appearance, the coating will be non-uniform and inhomogeneous. In practice, the height of the wave is less than 2 cm.

The apparatus of FIG. 1 is designed to produce a one-sided coating. For some applications, two sided coating is desirable. One way to produce a two sided coating on a substrate as discussed above is to use a porous substrate and allow the molten metal to interpenetrate the pores of the substrate. An alternative process which is used to coat both sides of a solid substrate is accomplished by utilizing the apparatus of FIG. 3.

Referring now to FIG. 3, substrate 14' is transported across coating station 16', which is identical to coating station 16 of FIG. 1. Coating station 16' includes vessel 18', molten metal bath 20', standing wave 22' and upper surface 50'. Standing wave 22' contacts the external surface of first coating roll 24' to enable the molten metal to be coated onto first coating roll 24. Apparatus 10' also includes second coating roll 26' which is in direct contact with first coating roll 24' as is shown in FIG. 3B. As will be discussed, both first coating roll 24' and second coating roll 26' are wider than substrate 14' to enable two sided coating of substrate 14'.

Figure 3A:
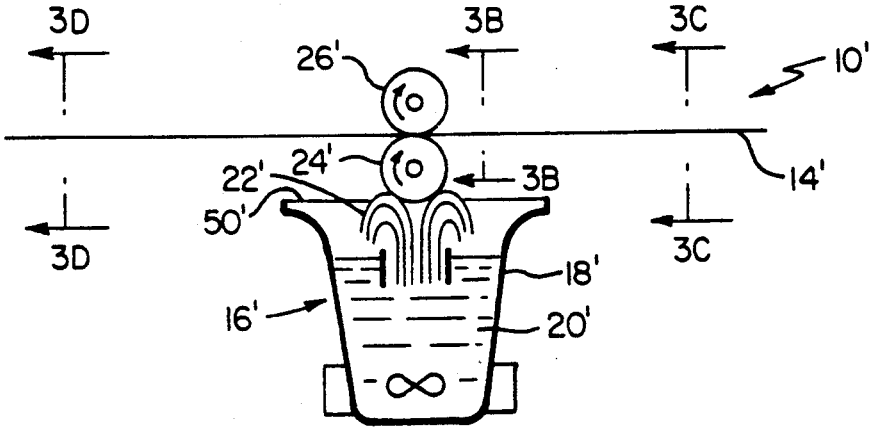
FIG. 3A is a schematic diagram of an apparatus useful for two sided coating embodying the teachings of the instant invention.
Figure 3B:
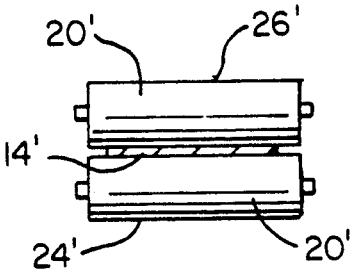
FIG. 3B illustrates a second coating roll which is in direct contact with the first coating roll.
Figure 3C:
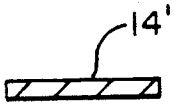
FIG. 3C illustrates a substrate as a uniform material having no surface coatings and FIG. 3D illustrates a substrate after coating on the upper and lower surfaces.
Figure 3D:
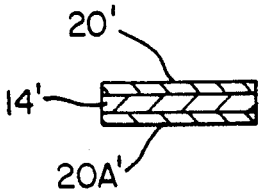

To effectuate two sided coating, substrate 14' is transported across first coating roll 24' by transport means, such as the unwinding and winding rotatable rolls of FIG. 1, not pictured. Prior to advancement across first coating roll 24', substrate 14', as seen in FIG. 3C is not coated on either of its surfaces, unless a precoating layer, as described above, has been applied. When substrate 14' is transported across first coating roll 24', the lower surface of substrate 14' is coated with molten metal 20'. To coat the upper surface of substrate 14', first coating roll 24' contacts second coating roll 26' to transfer the molten metal 20' which is not coated onto substrate 14' to the external surface of second coating roll 26'. Transfer is accomplished because of the direct contact between first coating roll 24' and second coating roll 26' and because the width of rolls 24' and 26' is greater than the width of substrate 14'. Once molten metal 20' has been transferred from first coating roll 24' to second coating roll 26', the rotation of second coating roll 26' causes molten metal 20' to migrate towards the center of the roll. Molten metal 20' is transferred from second coating roll 26' to the upper surface of substrate 14' by the direct contact of second coating roll 26' with substrate 14'. After coating, substrate 14' is cooled, preferably by exposure to inert ambient conditions to solidify the molten medal on both surfaces of substrate 14'. The solidified metal, as shown in FIG. 2D, is designated by reference numeral 20A'.

In practice, the coating apparatus and methods described above may be utilized for any coating operation where it is desirable to coat thin layers of a metal, particularly an alkali or alkaline earth metal onto a substrate. It is particularly preferred that the coating method be used for producing anode elements for solid state electrochemical cells wherein a current collector, such as a nickel or copper foil, is coated with a thin layer of reactive metal. The anode element can be laminated to a cathode element, or to a electrolyte which, in turn, is laminated to a cathode element to produce a completed cell. Other uses for the coating method and apparatus of the present invention include the coating of electrodes for other electrochemical devices such as electrochromic displays and super capacitors.

Having described the invention in detail and by referee to preferred embodiments thereof, it will be apparent that modifications and variations are possible without departing from the scope of the invention defined in the appended claims.

What is claimed is:

1. An apparatus for coating lithium metal onto a substrate comprising:

a vessel for maintaining a molten lithium metal;

circulating means in said vessel for circulating said molten lithium metal and causing said molten lithium metal to project above the upper surface of said vessel;

transport means for transporting a substrate across said vessel;

coating means comprising first rotating roll means for contacting molten lithium metal projected from said surface of said vessel means and transferring said projected molten lithium metal onto a surface of said substrate, whereby said projected molten lithium metal indirectly contacts said surface of said substrate; and heat sink means comprising chilling roll means for cooling the substrate, said chilling roll means being in contact with the surface of the substrate which is not coated with molten lithium metal wherein said chilling roll means is located at a position selected to be a first horizontal distance and a second vertical distance from said coating means, whereby lithium metal is solidified and the thickness thereof is adjusted to a predetermined thickness by selecting said horizontal and vertical distances and the temperature of said heat sink.

2. The apparatus according to claim 1 further comprising chilling roll locating means for controlling the horizontal and vertical location of said chilling roll means on the substrate.

3. The apparatus according to claim 1 wherein said circulating means projects the molten lithium metal as a standing wave whose crest extends above the upper surface of said vessel.

4. The apparatus according to claim 1 wherein said first rotating roll means is wider than the width of the substrate, and wherein said apparatus further comprises:

second rotating roll means for contacting the surface of the substrate not in contact with he first rotating roll means for transferring molten metal from said first rotating roll means to said second rotating roll means and to the surface of the substrate in contact with said second rotating roll means, said second rotating roll means being in contact with said first rotating roll means and the surface of the substrate not in contact with said first rotating roll means, said second rotating roll means being wider than the substrate.

* * * * *